US006425747B2

(12) United States Patent
Buchmüller et al.

(10) Patent No.: US 6,425,747 B2
(45) Date of Patent: Jul. 30, 2002

(54) GEARING WITH MATING INTERNAL AND SPUR GEARS

(75) Inventors: Klaus-Dieter Buchmüller, Malsch; Marco Grethel, Bühlertal, both of (DE)

(73) Assignee: LuK Lamellen und Kupplungsbau GmbH, Buhl/Baden (DE)

( * ) Notice: Subject to any disclaimer, the term of this patent is extended or adjusted under 35 U.S.C. 154(b) by 0 days.

(21) Appl. No.: 09/726,974

(22) Filed: Nov. 30, 2000

(30) Foreign Application Priority Data

Dec. 8, 1999 (DE) ..... 199 59 215

(51) Int. Cl.[7] ..... F04C 2/10
(52) U.S. Cl. ..... 418/126; 418/170
(58) Field of Search ..... 418/126, 169, 418/170

(56) References Cited

U.S. PATENT DOCUMENTS 5,032,069 A * 7/1991 Parsons ..... 418/170
5,667,448 A 9/1997 Friedmann ..... 474/18

FOREIGN PATENT DOCUMENTS

DE 37 23 557 A 1 1/1989
DE 43 22 239 A 1 1/1995
DE 199 23 851 A 1 12/1999
EP 0253133 * 1/1988 ..... 418/170
JP 55-35105 * 3/1980 ..... 418/126
JP 57-52694 * 3/1982 ..... 418/126

* cited by examiner

*Primary Examiner*—John J. Vrablik
(74) *Attorney, Agent, or Firm*—Darby & Darby

(57) ABSTRACT

A gearing, particularly for use in a gear pump which can be utilized in the power train of a motor vehicle, has a housing, a rotary internal gear in the housing, and a spur gear driven by a prime mover, mating with the internal gear and defining with the latter a crescent-shaped chamber for forcible conveying of a fluid, such as lubricant, from an inlet communicating with one end portion to an outlet communicating with the other end portion of the chamber. In order to avoid turbulent flow of fluid in the chamber, the latter is substantially filled by a composite insert. Such insert can comprise several crescent-shaped fillers with at least one seal between them, or two one-piece or composite fillers which are disposed end-to-end as seen in the circumferential direction of the internal gear and are separated from each other by an abutment which is secured to or of one piece with the housing.

12 Claims, 3 Drawing Sheets

GEARING WITH MATING INTERNAL AND SPUR GEARS

BACKGROUND OF THE INVENTION

This invention relates to improvements in gearings in general, and more particularly to improvements in gearings of the type wherein an internal gear surrounds a second gear having an annulus of external gear teeth in mesh with the annulus of gear teeth forming part of the internal gear. Gearings of the type to which the present invention pertains are often utilized in pumps, e.g., in so-called internal gear pumps which serve to supply a lubricant (such as oil) to various constituents of the power train in a motor vehicle.

Published German patent application Serial No. 199 23 851 discloses a gearing wherein a housing confines a rotary internal gear mating with a pinion which is installed within the internal gear and defines therewith a relatively large crescent-shaped chamber. The pinion receives torque from a prime mover (e.g., from the engine of a motor vehicle) by way of a shaft, such as a transmission shaft, and causes the internal gear to rotate about an axis which is parallel to the rotational axis of the pinion. One end of the crescent-shaped chamber communicates with an inlet (e.g., a port provided in the housing) for admission of a hydraulic fluid, and the other end of such chamber communicates with an outlet provided in the housing to receive a flow or stream of fluid which is pressurized on its way through the chamber.

A drawback of many presently known gearings of the above outlined character is that the flow of fluid through the crescent-shaped chamber is rather turbulent with attendant undesirable effect upon the characteristics of the body of fluid (such as lubricant) which is being conveyed into and beyond the outlet of the housing. For example, eddy currents developing in the body of liquid flowing through the crescent-shaped chamber can cause an overheating of a modern internal gear pump with attendant problems involving adequate cooling of the pressurized fluid and/or of the mechanical parts of the power train in a motor vehicle.

Internal gear pumps of the above outlined character are described and illustrated, for example, on pages 492–493 of "Modern Automotive Technology" authored by James E. Duffy and published in 1994 by The Goodheart-Willcox Company, Inc., Tinley Park, Ill. The gear pump which is described in this publication comprises an oil pump body or housing which confines a driven (internal) gear and a drive gear (pinion) which mates with the driven gear and receives torque from a so-called drive spline. The latter can receive torque from or can form part of the distributor, the crankshaft or an accessory shaft and mates with a driven spline in the drive gear. Lubricant (oil) at the inlet side of the pump is caught in the gear teeth and is carried around the outer wall inside the pump housing. When the lubricant reaches the outlet side of the pump, the gear teeth mesh and seal. Lubricant caught in each gear tooth is forced into the pocket at the pump outlet and pressure is formed. This causes the lubricant to squirt out of the pump and to the engine bearings and/or to other component parts which necessitate reliable, thorough, frequent or continuous lubrication. Such principle underlies the operation of a gear oil pump as well as that of an internal gear oil pump.

As utilized in this specification and in the appended claims, the term "spur gear" is intended to denote a gear (such as a pinion) having an annulus of external teeth regardless of the exact configuration and/or orientation of the teeth (i.e., (helical) teeth set obliquely to the axis of rotation, radial teeth parallel to the axis of the wheel, or others).

Commonly owned U.S. Pat. No. 5,667,448 (granted Sep. 16, 1997 to Oswald Friedmann for "POWER TRAIN") discloses certain features of a power train which can employ an internal gear pump for a suitable lubricant, such as oil.

OBJECTS OF THE INVENTION

An object of the present invention is to provide a novel and improved gearing of the type wherein a housing confines an internal gear and a spur gear mating with the internal gear.

Another object of the invention is to provide a novel and improved internal gear pump which can be utilized with advantage in the power trains of motor vehicles.

A further object of the instant invention is to provide a novel and improved method of influencing the flow of a hydraulic fluid (such as oil) through the crescent-shaped chamber of an internal gear pump.

An additional object of the invention is to provide a novel and improved method of enhancing the performance of an internal gear pump which can be utilized with advantage in the lubricating systems of power trains in motor vehicles.

Still another object of the invention is to provide a gearing of the type wherein an internal gear and a spur gear mate in a housing and define a crescent-shaped chamber, particularly for compression of a hydraulic fluid entering at one end of the chamber and exiting at the other end.

A further object of the invention is to provide novel and improved means for preventing or greatly reducing turbulence in the sickle-shaped chamber between an internal gear and a spur gear in the housing of an internal gear pump, especially for use in the power trains of motor vehicles.

Another object of the invention is to provide novel and improved inserts for use in the sickle-shaped chambers of gearings employing mating internal gears and spur gears.

An additional object of the invention is to provide a gearing which constitutes an improvement over and a further development of gearings disclosed in the aforementioned published German patent application Serial No. 199 23 851 as well as in published German patent applications Serial Nos. 37 23 557 A1 and 43 22 239 A1.

Still another object of the invention is to provide an internal gear pump which constitutes an improvement over and a further development of pumps of the type disclosed in the aforementioned published German patent applications.

SUMMARY OF THE INVENTION

One feature of the present invention resides in the provision of a gearing which comprises a housing, an internal gear which is rotatably mounted in the housing, and a spur gear which is rotatably mounted in the housing, which mates with the internal gear and which defines with the internal gear a substantially crescent-shaped chamber. The improved gearing further comprises an engine- or motor-driven shaft or other suitable means for rotating one of the gears to thus rotate the other gear, and an insert which is provided in and at least substantially fills the chamber. The insert includes a first filler, at least one abutment for the first filler, and a second filler.

The at least one abutment is or can be disposed between the first and second fillers, as seen in the circumferential direction of the internal gear.

At least one of the fillers has or can have an outline resembling a portion of the outline of the substantially crescent-shaped chamber. Such at least one filler can occupy approximately one-half of the chamber. For example, each of the fillers can have an outline resembling that of a portion of the substantially crescent-shaped chamber, and each filler can occupy approximately one-half of the chamber.

At least one of the fillers can comprise a plurality of (e.g., two) discrete sections. The arrangement can be such that the insert comprises only two fillers, that one of the fillers is a one-piece component, and that the other filler comprises a plurality of sections.

The housing can be provided with a fluid-admitting inlet which communicates with one end portion of the chamber and with a fluid-evacuating outlet which communicates with the other end portion of the chamber. The two end portions of the chamber are spaced apart from each other as seen in the circumferential direction of the internal gear. One of the fillers of the insert can be installed in the chamber adjacent the inlet, and the other filler of the insert can be installed in the chamber adjacent the outlet. The at least one abutment is or can be rigid with the housing and can be disposed intermediate the one filler and the other filler, as seen in the circumferential direction of the internal gear.

The housing can form part of an internal gear pump.

In many or most instances, the engine- or motor driven gear is the spur gear.

One of the fillers can comprise discrete first and second sections and at least one sealing element between the first and second sections.

The means for rotating the one gear can comprise a power-driven drive spline and a complementary internal spline provided in the spur gear and meshing with the drive spline.

Certain teeth of the internal gear mate with the adjacent teeth of the spur gear in a region which is adjacent the inlet and/or the outlet of the chamber, for example, in a region located between the inlet and the outlet and opposite the chamber.

Another feature of the invention resides in the provision of a gearing which comprises a housing, an internal gear which is rotatably mounted in the housing, and a spur gear which is rotatably mounted in the housing, which mates with the internal gear and which defines with the internal gear a substantially crescent-shaped chamber. The improved gearing further comprises means for rotating one of the gears to thus rotate the other gear by way of the one gear, and a substantially crescent-shaped insert which is provided in and at least substatially fills the chamber. The insert or the housing has an elongated groove, and the housing or the insert has a follower which extends into the groove.

The groove can be provided in the insert and the follower then includes a first portion which is rigid with or is rotatably or turnably mounted in the housing and a second portion which extends into the groove.

The chamber has first and second end portions which are spaced apart from each other as seen in the circumferential direction of the internal gear, and the housing is or can be provided with an inlet in communication with one end portion and an outlet in communication with the other end portion of the chamber.

The insert can comprise at least two discrete fillers.

The novel features which are considered as characteristic of the invention are set forth in particular in the appended claims. The improved gearing itself, however, both as to its construction and the modes of assembling and utilizing the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
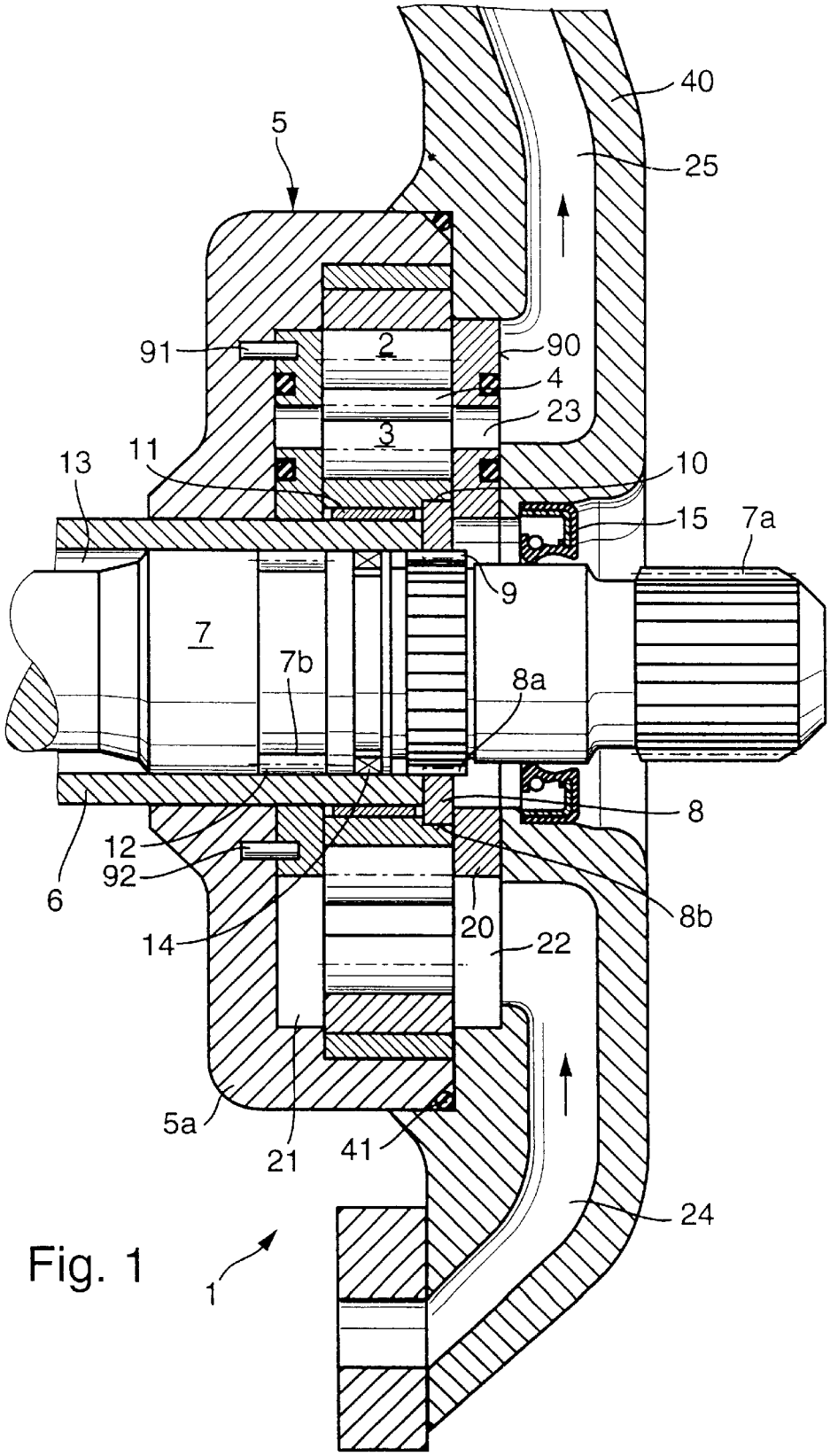
FIG. 1 is an axial sectional view of an internal gear oil pump which can be utilized to convey pressurized oil or another suitable lubricant into the case of a transmission in the power train of a motor vehicle.

FIG. 1 illustrates certain details of a gearing 1 which is embodied in an internal gear oil pump. The gearing 1 comprises a housing 5 having a bore or compartment 4 for a rotary internal gear 2 and a rotary spur gear 3 which is surrounded by the gear 2 and has an annulus of external gear teeth some of which mate with the adjacent internal teeth of the gear 2. The gear 3 is rotatable about the axis of a tubular bearing member 6 which is installed in the housing 5. The bearing member 6 surrounds a shaft 7, e.g., a transmission shaft in the power train of a motor vehicle. The shaft 7 carries a connector 8 which cannot rotate relative to the shaft. This connector is a ring acting as a drive spline which rotates with the shaft 7 and is non-rotatably coupled to the gear 3. Thus, when the shaft 7 receives torque from a prime mover (such as the internal combustion engine, not shown, of a motor vehicle), gear 3 will share the rotation of shaft 7 and thereby drive gear 2 to turn with the same sense of rotation as gear 3.

The ring-shaped connector (drive spline) 8 has one or more (e.g., three equidistant) internal projections 8*a* in the form of teeth or the like which extend into complementary splines or tooth spaces 9 of the shaft 7 to thus establish a torque-transmitting connection between the parts 7 and 8. The connector 8 is further provided with external teeth or analogous projections 8*b* extending into complementary tooth spaces 10 in the interior of the gear 3. Thus, the connector 8 can be said to constitute a power-driven drive spline and the radially innermost portion of the gear 3 can be said to constitute a complementary internal spline meshing (at 10) with the drive spline to receive torque from the shaft 7 and to transmit torque to the internal gear 2. The connector 8 can be provided with a single external projection 8*b* or with two or more (e.g., three) equidistant projections 8*b* which extend into the tooth spaces 10 of the gear 3.

The gear 3 surrounds a bearing 11 (e.g., a simple sleeve-like friction bearing or slide bearing, or a standard antifriction roller bearing) which, in turn, surrounds the sleeve-like bearing member 6. The latter is non-rotatably mounted in the housing 5. The bearing 11 can be a simple antifriction roller bearing with balls or other suitable rolling elements directly contacting the external surface of the bearing member 6. If the bearing 11 is a ball or roller or needle type bearing and the member 6 constitutes the inner race of such bearing, this member is preferably hardened in accordance with any suitable technique.

A further bearing 12 (such as a sleeve-like or roller bearing) is installed between the internal surface of the member 6 and the external surface of the shaft 7. If the bearing 12 comprises a set of spherical or otherwise configurated (such as needle-like) rolling elements, the shaft 7 can constitute the inner race and the member 6 can constitute the outer race of such bearing. FIG. 1 shows that the bearing 12 (preferably an antifriction roller or needle bearing) is received in an external groove 7*b* of the shaft 7.

In the embodiment of FIG. 1, the bearing 12 is installed in the groove 7*b* adjacent the surface at the bottom of the compartment 4 in the housing 5. However, it is also possible to install the bearing 12 within the confines of the internal gear 2. In the illustrated axial position, the bearing 12 can take up radially inwardly oriented stresses which would tend to subject the sleeve-like bearing member 6 to deforming stresses, at least to dynamic deforming stresses. Instead of transmission of such radial stresses to the bearing member 6, the bearing 12 can transmit these stresses to the much sturdier shaft 7 which can readily withstand pronounced dynamic and/or other stresses developing and acting radially inwardly when the gearing 1 is in use.

Another advantage of the gearing 1 is that it need not employ an additional power input member, i.e., an additional drive shaft. The shaft 7 can perform such function in addition to its function as part of the transmission. In many instances, the shaft 7 can be journalled in such a way that it does not require any additional bearing or bearings in the region of the pump, i.e., adjacent the gears 2 and 3. In FIG. 1, the bearing for the shaft 7 merely includes the sleeve-like member 6 and the aforediscussed friction or antifriction bearing 12.

The bearing 12 is lubricated by a suitable fluid (such as oil) which fills a plenum chamber 13 of the transmission including the shaft 7. To this end, a sealing ring 14 which is recessed into the circumferential groove of the shaft 7 within the sleeve-like bearing member 6 is dimensioned, configurated and installed in such a way that it allows lubricant to flow from the plenum chamber 13 to the bearing 12. In fact, the sealing ring 14 is installed outside of the shortest path for direct flow of lubricant from the plenum chamber 13 to the bearing 12, i.e., the ring 14 is installed to the right of the chamber 13 and the bearing 12 as seen in FIG. 1. The ring 14 is in sealing engagement with the adjacent portion of the internal surface of the sleeve-like bearing member 6 and in sealing engagement with the surface bounding the groove in the external surface of the shaft 7 so that it prevents escape of lubricant toward the connector 8.

A corrugated annular seal 15 (or another suitable ring-shaped sealing element) establishes a reliable sealing action between the shaft 7 and the adjacent portion of the transmission case 40.

The housing 5 is preferably a composite housing which, in the embodiment of FIG. 1, comprises two plates or walls 20, 21 and a central part 5*a*. The latter defines the compartment 4 which confines the gears 2 and 3. The compartment 4 is sealed from the surrounding area save for the provision of a fluid-admitting inlet 22 and a fluid-evacuating outlet 23. The transmission case 40 has a first channel 24 for admission of fluid into the compartment 4 via inlet 22, and a second channel 25 for evacuation of pressurized fluid from the compartment 4 via outlet 23.

The plate 20 of the housing 5 is received in a recess 90 of the transmission case 40 and is adjacent the right-hand end face of the main portion 5*a* of the housing. The transmission case 40 can be provided with a lid (not shown) which can be opened to afford access to the plate 20. Such arrangement enables the plate 20 of the housing 5 of the gearing 1 to reinforce the transmission case 40 in the region of the gearing. The housing 5 is affixed to the transmission case 40 by suitable fasteners, e.g., by threaded fasteners which are omitted in FIG. 1 for the sake of clarity. The illustrated mounting of the housing 5 on the transmission case 40 exhibits the advantage that it occupies a small amount of space (as seen in the axial direction of the gears 2 and 3) and that it can stand pronounced axial and other stresses.

The plates 20, 21 are anchored in the main portion 5*a* of the housing 5 by at least two parallel pins or studs 91 and 92. It is also possible to anchor the plates 20, 21 in the transmission case 40 by means of pins or analogous parts in addition to or in lieu of the anchoring pins 91, 92. Such pins extend into suitable blind bores or holes provided in the plates 20, 21 and in the transmission case 40 and/or main housing portion 5*a*. The purpose of such anchoring means is to prevent (or to greatly reduce the likelihood of) undesirable stray movements of the parts 5*a*, 20, 21, 40 relative to each other, for example, to hold the plates 20, 21 against friction-induced angular movements in their respective planes and/or against axial movements toward and/or away from each other.

It is often advisable to fix at least one of the plates 20, 21 against axial movement relative to the gears 2, 3, e.g., in the region of an entraining element and an abutment or stop.

As already mentioned hereinbefore, the housing 5 of the gearing 1 is secured to the transmission case 40 by means of suitable threaded fasteners or the like, not shown. Such fasteners can extend through bores or holes (not shown) in the housing 5 and into tapped bores or holes in the transmission case 40. This mode of securing the housing 5 to the transmission case 40 is preferred at this time because the through bores or holes and the tapped bores or holes need not be sealed to prevent escape of fluid from the compartment 4 into the atmosphere or the inflow of air into the compartment 4.

It is further advisable to adequately seal the bore 4 from the atmosphere by one or more sealing elements (one shown at 41) interposed between the housing 5 and the transmission case 40.

The shaft 7 is or can constitute the input shaft of the transmission. The reason is that the RPM of the input shaft normally exceeds that of the output shaft. The illustrated shaft 7 has external teeth 7*a* which receive torque from a gear or belt or chain (not shown) driven by a prime mover.

The structure shown in FIG. 1 is identical with that shown in FIG. 1 of the aforementioned published German patent application Serial No. 199 23 851 A1.

Figure 2:
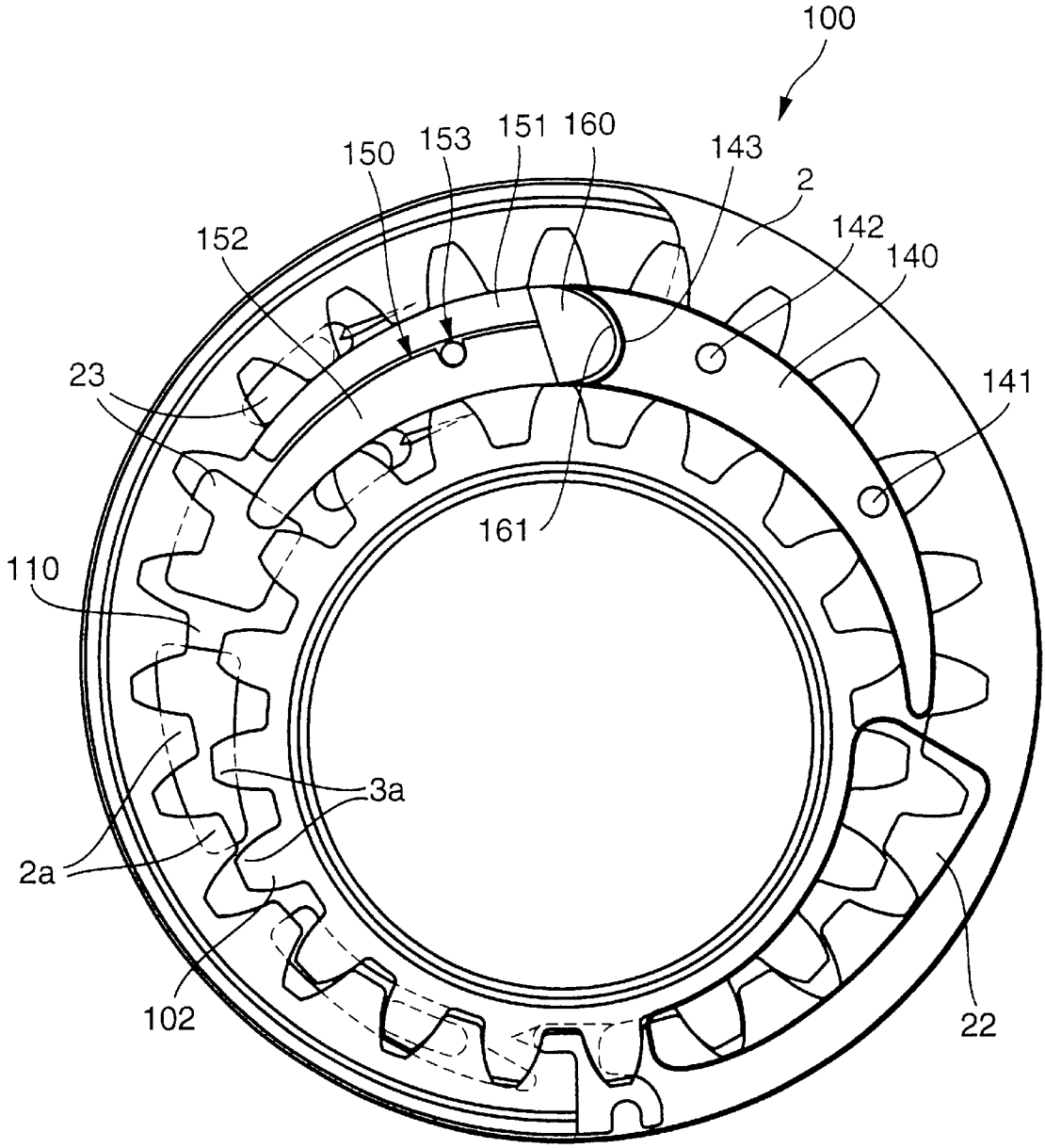
FIG. 2 is a front elevational view of certain parts of a gearing which is installed in the pump of FIG. 1 and wherein a crescent-shaped chamber which is defined by an internal gear and a spur gear is substantially filled by a composite insert including a one-piece filler, a two-piece filler and an abutment between the fillers.

FIG. 2 illustrates certain details of the gearing 100 which embodies one presently preferred form of the instant invention. The gearing 100 includes the housing 5 of FIG. 1 for the rotary internal gear 2 and the spur gear 3 which mates with and is surrounded by the internal gear. The spur gear 3 is driven by the shaft 7 (not shown in FIG. 2) in a manner as described in connection with FIG. 1. Some of the external gear teeth 3*a* of the spur gear 3 mate with the adjacent internal gear teeth 2*a* of the gear 2 in the region of the inlet 22 provided in the housing 5 for the admission of fluid into the adjacent end portion of a crescent-shaped chamber 110 defined by the gears 2, 3 in the region where their gear teeth 2*a*, 3*a* are out of mesh or in partial mesh with each other. The other end portion of the chamber 110 communicates with the outlet 23 of the housing 5.

In accordance with a feature of the invention, that portion of the chamber 110 which extends between the inlet 22 and the outlet 23 is at least substantially completely occupied by a composite crescent-shaped insert including a first filler 140 and a second filler 150. Each of these fillers takes up approximately one-half of the chamber 110 and its shape conforms to or resembles the outline of the respective half of the chamber, i.e., each of the fillers can be said to resemble one-half of a crescent or sickle having an outline corresponding to that of the chamber 110 between the inlet 22 and the outlet 23.

The filler 140 is of one piece (i.e., a single piece of a suitable metallic or plastic material) and is secured to the housing 5 by means of suitable fasteners 141, 142 (e.g., by threaded fasteners). This filler is adjacent the inlet 22. The other filler 150 comprises two sections or parts 151, 152 and is adjacent the outlet 23. The section 152 has a groove or recess for a sealing element 153 which engages the section 151. The purpose of this sealing element is the same as that of the sealing element shown in FIG. 3 of the German patent application Serial No. 199 23 851 and of sealing elements shown in FIGS. 2 and 3 of published German patent application Serial No. 43 22 239 A1. Each of these German patent applications discloses and shows an insert which occupies only one-half of the crescent-shaped chamber.

The insert including the fillers 140, 150 further comprises an abutment 160 which has end portions recessed in blind bores or holes of the plates or walls 20, 21 and serves as a stop for the sections 151, 152 of the composite filler 150. The other filler 140 has a concave end face 143 adjacent a complementary convex surface of the abutment 160.

The advantage of the insert including the fillers 140, 150 and the abutment 160 is that they effectively prevent eddying and/or other forms of undesirable turbulence in the stream of hydraulic fluid flowing from the inlet 22 through the unoccupied portion of the chamber 120 and the adjacent tooth spaces between the teeth 2*a* as well as between the teeth 3*a*. Such absence of turbulence is highly desirable for a number of important reasons such as preventing overheating of the conveyed fluid and of the pump, more predictable flow of fluid from the inlet 22 to the outlet 23 and greater predictability of pressurization of fluid on the way from the inlet 22 to the outlet 23 of the housing 5.

Figure 3:
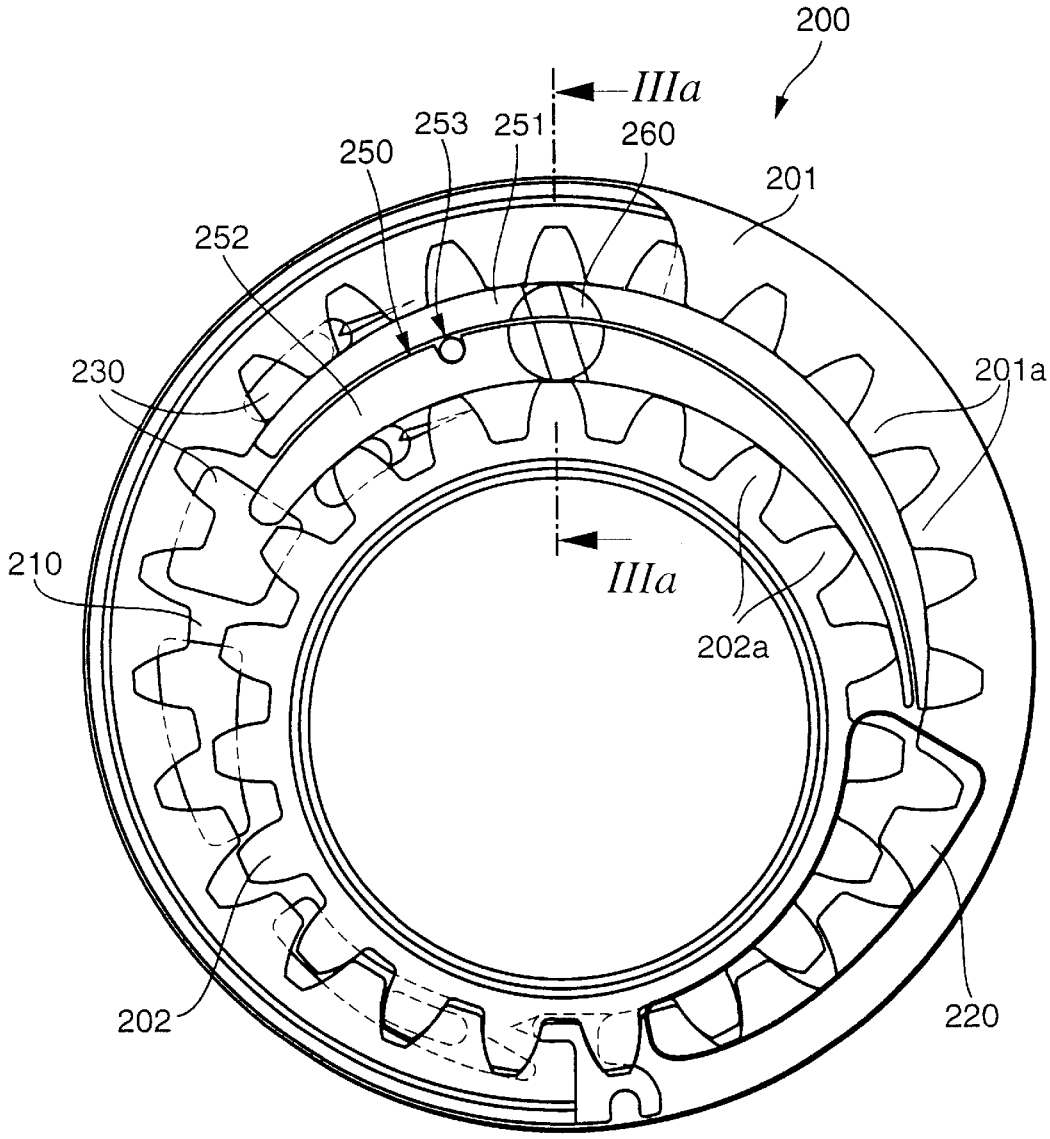
FIG. 3 is a similar front elevational view of certain parts of a modified gearing wherein the crescent-shaped chamber contains an insert including a one-piece filler, a two-piece filler and a projection having a follower extending into a groove of one of the fillers.

FIG. 3 illustrates certain novel features of a modified gearing 200 having a housing 205 (FIG. 3*a*) corresponding to the housing 5 of FIG. 1, an internal gear 201 rotatably mounted in the housing 205, and a spur gear 202 mating with the internal gear 201. The gear 202 is driven by a shaft (such as the shaft 7 shown in FIG. 1) and rotates the gear 201 when the gearing 200 is in use. The gears 201, 202 define a crescent-shaped chamber 210 one end portion of which communicates with the inlet 220 and the other of which communicates with the outlet 230 of the housing 205. The teeth 201*a* of the internal gear 201 mate with the teeth 202*a* of the spur gear 202 in the region opposite the chamber 210.

A major part well in excess of one-half of the chamber 210 is filled by a composite sickle- or crescent-shaped insert 250 including two crescent-shaped fillers 251, 252. The inner filler 252 has an axially parallel groove for a sealing element 253 which bears against the adjacent concave side of the outer filler 251. When the gearing 200 is in use, i.e., when the gear 202 drives the gear 201 so that a hydraulic fluid is pressurized on its way through the chamber 210 in a direction from the inlet 220 toward the outlet 230, the insert 250 is urged against a projection 260 which is rotatably mounted in the housing 205 and has a follower 261 extending into a groove 255 of the insert 250. The follower 261 has a substantially rectangular outline (see FIG. 3*a*) and the insert 250 is movable relative to the housing 205.

The insert 250 fills the chamber 210 to such an extent that the turbulence in the stream of fluid flowing in the chamber 210 from the inlet 220 to the outlet 230 is nil or negligible.

The manner in which the projection 260 is mounted in the housing 205 (e.g., between two plates or walls corresponding to the plates 20, 21 shown in FIG. 1) is or can be the same as shown in FIG. 2 or 3 of published German patent application Serial No. 37 23 557 A1.

Figure 3A:
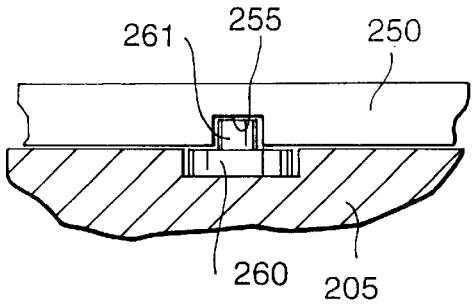
FIG. 3*a* is a fragmentary sectional view substantially as seen in the direction of arrows from the line IIIa—IIIa of FIG. 3.

The exact nature of the material of which the insert of FIG. 2 or the insert of FIGS. 3 and 3*a* is made depends upon a variety of factors such as the purpose of the gearing, the range of pressures to which the fluid is subjected on its way from the inlet to the outlet of the housing, and the quantity of fluid being conveyed per unit of time. In many instances, the insert will be made of a metallic or a plastic material.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. A gearing comprising:

a housing;

an internal gear rotatably mounted in said housing;

a spur gear rotatably mounted in said housing, mating with said internal gear and defining with the latter a substantially crescent-shaped chamber;

means for rotating one of said gears to thus rotate the other of said gears; and an insert provided in and at least substantially filling said chamber, said insert comprising a first filler and an abutment for said first filler;

wherein the first filler is movable relative to said housing and comprises two separate sections adjoining each other along a circumferentially extending separation with at least one sealing element between the separate sections.

2. The gearing of claim 1, wherein said housing forms part of a pump.

3. The gearing of claim 1, wherein said one gear is said spur gear.

4. The gearing of claim 1, wherein said means for rotating comprises a power-driven drive spline and a complementary internal spline provided in said spur gear and meshing with said drive spline.

5. The gearing of claim 1, wherein the insert further comprises a second filler and said at least one abutment is disposed between said fillers, as seen in a circumferential direction of said internal gear.

6. The gearing of claim 5, wherein the second filler is of one piece.

7. The gearing of claim 5, wherein at least one of said fillers has an outline resembling a portion of said substantially crescent-shaped chamber.

8. The gearing of claim 7, wherein said at least one filler occupies approximately one-half of said chamber.

9. The gearing of claim 7, wherein each of said fillers has an outline resembling a portion of said substantially crescent-shaped chamber and each of said fillers occupies approximately one-half of said chamber.

10. The gearing of claim 5, wherein said chamber has first and second end portions spaced apart from each other in a circumferential direction of said internal gear, said housing having an inlet communicating with one end portion and an outlet communicating with the other end portion of said chamber.

11. The gearing of claim 10, wherein one of said fillers is adjacent said inlet and the other of said fillers is adjacent said outlet.

12. The gearing of claim 11, wherein said abutment is rigid with said housing.

* * * * *